US012285698B2

(12) United States Patent
Muraki et al.

(10) Patent No.: US 12,285,698 B2
(45) Date of Patent: Apr. 29, 2025

(54) TOP LAUNCHING DEVICE

(71) Applicant: TOMY COMPANY, LTD., Tokyo (JP)

(72) Inventors: Makoto Muraki, Tokyo (JP); Kei Nishizawa, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 257 days.

(21) Appl. No.: 18/103,866

(22) Filed: Jan. 31, 2023

(65) Prior Publication Data

US 2024/0066417 A1 Feb. 29, 2024

(30) Foreign Application Priority Data

Aug. 23, 2022 (JP) ..... 2022-132508

(51) Int. Cl.
*A63H 1/04* (2006.01)
*A63H 29/24* (2006.01)
*A63H 31/06* (2006.01)

(52) U.S. Cl.
CPC ..... *A63H 1/04* (2013.01); *A63H 29/24* (2013.01); *A63H 31/06* (2013.01)

(58) Field of Classification Search
CPC ... A63H 1/00; A63H 1/02; A63H 1/04; A63H 29/24; A63H 31/06
USPC ..... 446/236, 256, 259, 261, 262, 263
See application file for complete search history.

(56) References Cited

U.S. PATENT DOCUMENTS 3,701,216 A * 10/1972 Smith, III ..... A63H 29/24 185/39
6,221,409 B1 * 4/2001 Bueno Ceresuela .... A23G 9/44 426/104
6,739,939 B2 * 5/2004 Matsukawa ..... A63F 3/00895 446/259
6,743,070 B1 * 6/2004 Lin ..... A63H 33/28 446/259
7,427,225 B2 * 9/2008 Matsukawa ..... A63H 1/06 446/259
7,500,898 B2 * 3/2009 Laurienzo ..... A63H 27/14 446/429

(Continued)

FOREIGN PATENT DOCUMENTS

JP 5990353 B1 * 9/2016
JP 6960644 B1 * 11/2021
KR 20150022267 A * 8/2013

*Primary Examiner* — Alexander R Niconovich
(74) *Attorney, Agent, or Firm* — IP Business Solutions, LLC.

(57) ABSTRACT

A top launching device for launching a top includes a device body and an operating belt. The device body includes first and second input rotors to rotate, an output rotor configured to hold the top in a state with a central axis of the output rotor aligned with a central axis of the top and configured to rotate and impart the rotational force to the top, and a coupling rotor configured to transmit the rotational force from the input rotor to the output rotor. The operating belt is configured to be inserted in the device body, and to be engaged with either the first or the second input rotor. The output rotor is configured to rotate the top, impart the rotational force to the top, and release the top. The operating belt is configured to be selectively engaged with one of the first and second input rotors.

10 Claims, 9 Drawing Sheets

(56) References Cited

U.S. PATENT DOCUMENTS 7,568,578 B2 * 8/2009 Berman ..... A63H 29/24 206/471
7,594,843 B2 * 9/2009 Vetuskey ..... A63H 17/006 463/58
8,128,454 B2 * 3/2012 Rosenblum ..... A63H 17/008 463/58
8,568,191 B2 * 10/2013 Rehkemper ..... A63F 9/16 446/259
8,715,032 B2 * 5/2014 Horikoshi ..... A63H 1/12 446/259
8,920,209 B2 * 12/2014 Brooks ..... A63H 1/24 446/236
9,180,379 B2 * 11/2015 Choi ..... A63H 1/02
9,643,095 B2 * 5/2017 Choi ..... A63H 1/04
9,737,822 B2 * 8/2017 Kubo ..... A63H 1/04
9,849,394 B1 * 12/2017 Shindo ..... A63F 9/16
9,968,860 B2 * 5/2018 Shindo ..... A63H 1/04
10,080,975 B2 * 9/2018 Choi ..... A63H 1/04
10,799,805 B2 * 10/2020 Hama ..... A63H 1/02
10,960,316 B2 * 3/2021 Cardona Rivera .... A63H 29/24
11,110,362 B2 * 9/2021 Hama ..... A63F 9/16
11,541,320 B2 * 1/2023 Kim ..... A63H 1/18
11,986,744 B2 * 5/2024 Bando ..... A63H 1/02
2006/0099880 A1 * 5/2006 Laurienzo ..... A63H 29/24 446/236
2008/0194173 A1 * 8/2008 Tiefel ..... A63H 1/04 446/236
2009/0253345 A1 * 10/2009 Ujita ..... A63H 1/04 446/263
2011/0177750 A1 * 7/2011 Ujita ..... A63H 1/04 446/263
2011/0256794 A1 * 10/2011 Horikoshi ..... A63H 1/04 446/259
2016/0175721 A1 * 6/2016 Choi ..... A63H 1/04 446/259

* cited by examiner

TOP LAUNCHING DEVICE

CROSS-REFERENCE TO THE RELATED APPLICATION

This application claims priority to Japanese Patent Application No. 2022-132508 filed on Aug. 23, 2022. The entire content of Japanese Patent Application No. 2022-132508 is incorporated herein by reference.

TECHNICAL FIELD

The present invention relates to a top launching device.

BACKGROUND

Conventionally known as a top launching device is a top launching device comprising: an input unit having an input rotor in which rotational force is inputted by operation of an operating means; an output unit having an output rotor that holds the top in a state with its own central axis aligned with the central axis of a top and imparts rotational force to the top; and a coupling unit having a coupling rotor that couples the input rotor and the output rotor and transmits rotational force (see Patent Document 1).

According to this top launching device, by operation of the operating means, rotational force is inputted to the input rotor and the top is rotated together with the output rotor, and by releasing holding of the top by the output rotor during rotation of the top, the top is rotationally energized and launched.

Patent Document 1: Japanese Patent Publication No. 6,960,644

SUMMARY

Problems the Invention is Intended to Solve

However, in the top launching device noted in the above-mentioned Patent Document 1, the configuration is such that to change the rotation speed of the top being launched, the number of teeth of a coupling gear which is the coupling rotor is changed through exchanging of the coupling unit to change the gear ratio of the rotation transmitted from the input rotor.

However, for exchanging of the coupling unit, the work of removing the original coupling unit and also mounting a new coupling unit, etc., is required, and that work was troublesome. It was also necessary to prepare a plurality of bulky coupling units, so storage and carrying was difficult.

The present invention takes these points into consideration, and its main purpose is to provide a top launching device in which the gear ratio can be changed easily.

Means for Solving the Problems

A top launching device for launching a top includes a device body and an operating belt. The device body includes first and second input rotors to rotate by rotational force, an output rotor configured to hold the top in a state with a central axis of the output rotor aligned with a central axis of the top and configured to rotate and impart the rotational force to the top, and a coupling rotor configured to transmit the rotational force from the input rotor to the output rotor. The operating belt is configured to be inserted in the device body, and to be engaged with either the first or the second input rotor when the operating belt is in the device body. The first and the second input rotors are configured to rotate by a user pulling the operating belt from the device body. The output rotor is configured to rotate the top, impart the rotational force to the top, and release the top. The first input rotor has a first gear ratio. The second unput rotor has a second gear ratio being different from the first gear ratio. The operating belt is configured to be selectively engaged with one of the first and second input rotors.

DETAILED DESCRIPTION OF THE PREFERRED EMBODIMENTS

Hereafter, a top launching device according to embodiments of the present invention is explained.

First Embodiment

Figure 1:
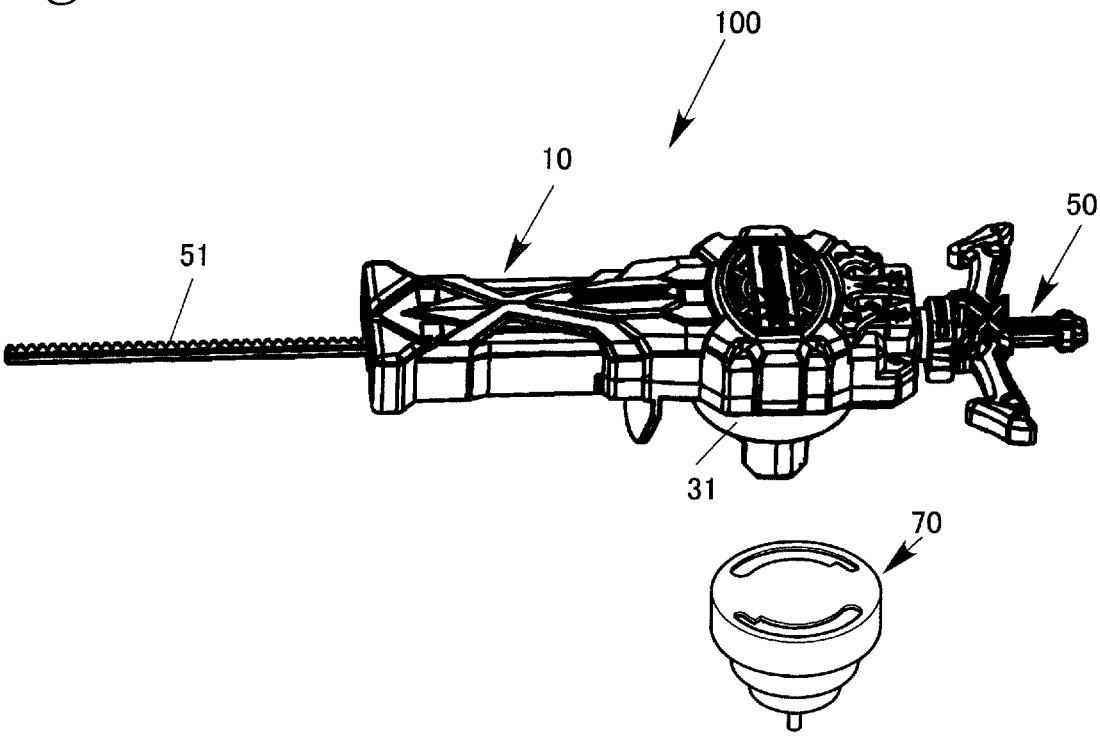
FIG. 1 is a perspective view of a top launching device and a top according to a first embodiment.

FIG. 1 is a perspective view of a top launching device 100 and a top 70 according to a first embodiment.

The top launching device 100 includes a device body 10 and an operating belt 50 that is an operating means. The device body 10 is of a size that can be held in one hand, and the top 70 is held in a top holder (output rotor) 31 of this device body 10. Then, after a belt part 51 of the operating belt 50 is inserted in the device body 10, the top 70 is faced downward and the operating belt 50 is pulled out from the device body 10, the top 70 is rotationally energized, and is launched from the device body 10.

Hereafter, the top 70, the operating belt 50, and the device body 10 are described in detail in this order.

Top 70

Figure 2:
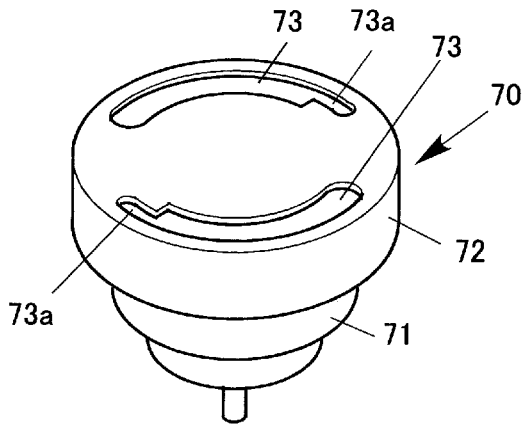
FIG. 2 is a perspective view of the top.

FIG. 2 is a perspective view of the top 70.

The top 70 includes a shaft part 71 and a trunk part 72. On the top surface of the trunk part 72, one each of an arc-shaped groove 73 concentric with the rotation axis are formed at two positions facing opposite sandwiching the rotation axis (top axis) of the top 70. One end in the extension direction of the arc-shaped groove 73 has a narrow width. It is possible for a locking projection 31*d* of the device body 10 described later to get under the edge wall of a narrow-width part 73*a*. By the locking projection 31*c* getting under the edge wall of this narrow-width part 73*a*, the top 70 is held by the device body 10.

The narrow-width part 73*a* is provided at the clockwise direction side end of the arc-shaped groove 73 in the top 70 for clockwise rotation, and at the counterclockwise direction side end of the arc-shaped groove 73 in the top 70 for counterclockwise rotation. Also, the narrow-width part 73*a* is provided at both ends of the arc-shaped groove 73 in the top 70 for both rotations. The top 70 shown in FIG. 2 has the narrow-width part 73*a* provided at the clockwise direction side end of the arc-shaped groove 73, so is a top for clockwise rotation.

Operating Belt 50

Figure 3:
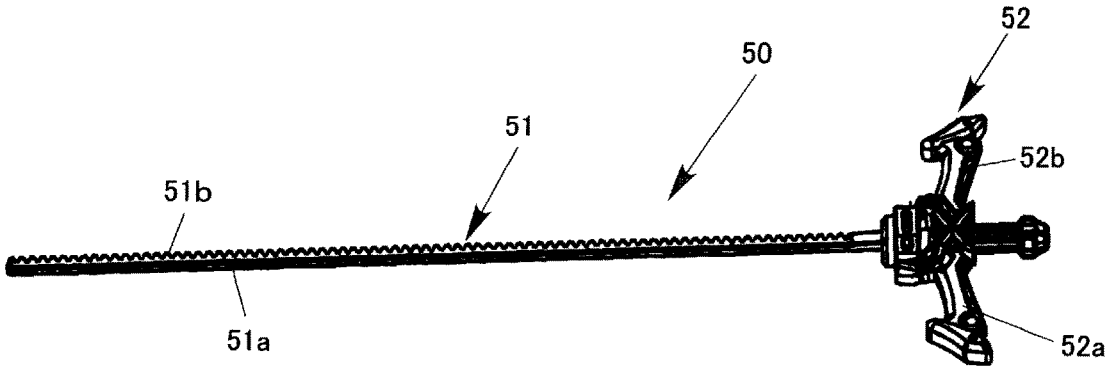
FIG. 3 is a perspective view of the operating belt.

FIG. 3 is a perspective view of the operating belt 50.

The operating belt 50 includes an operating unit 52, and a belt part 51 coupled to the operating unit 52.

The operating unit 52 has finger hooking parts 52*a*, 52*b* for hooking the index finger or middle finger of the right hand, for example. The belt part 51 has many teeth 51*b* formed along the longitudinal direction of a rod-shaped base 51*a*.

Device Body 10

Figure 4:
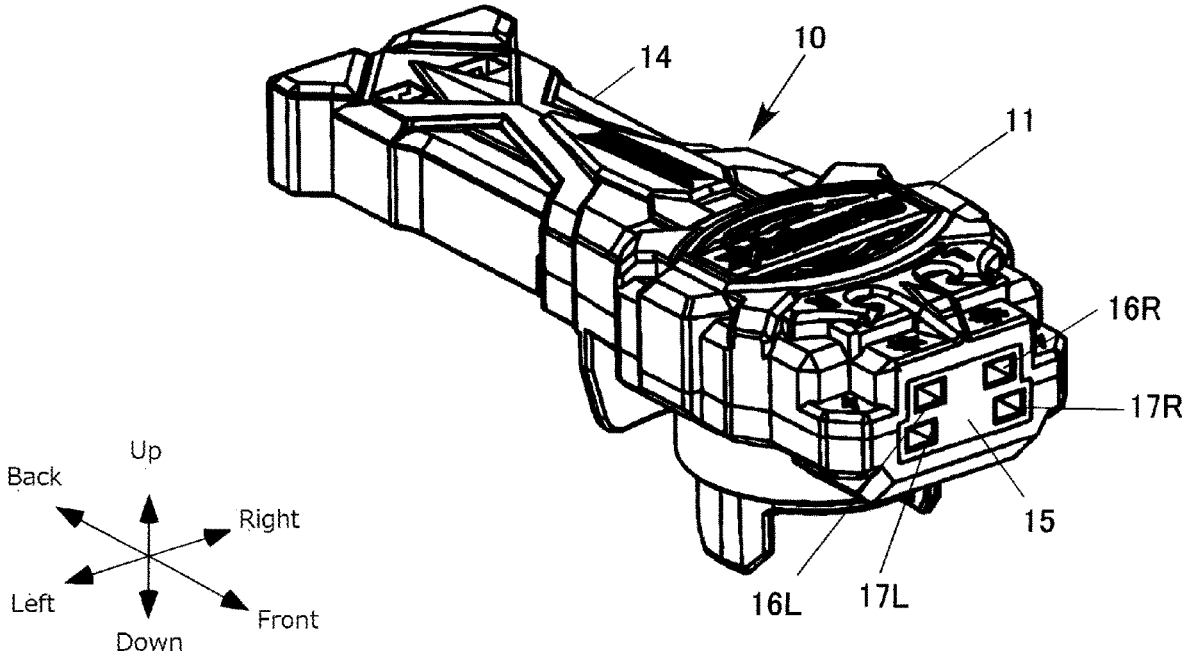
FIG. 4 is a perspective view of the device body.
Figure 5:
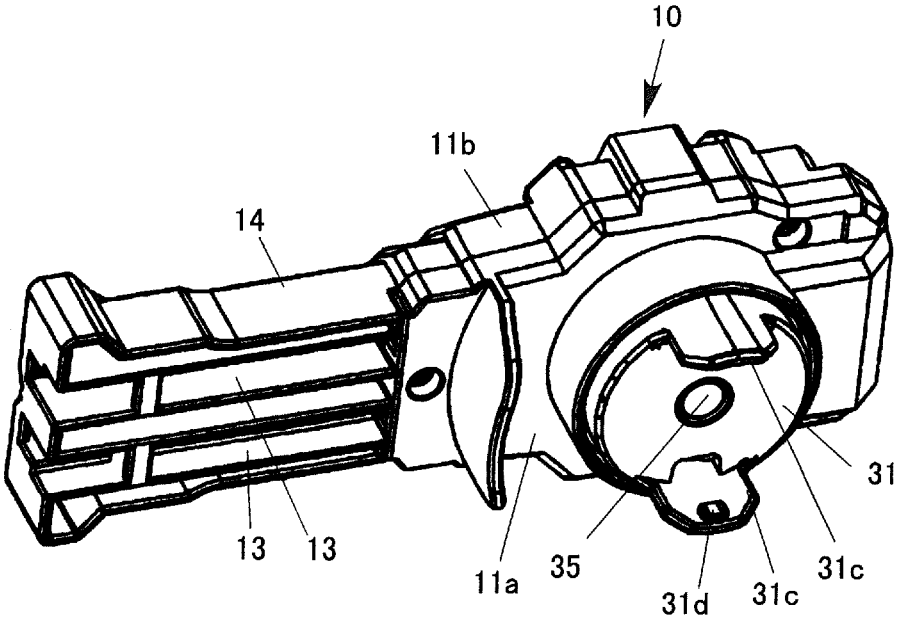
FIG. 5 is a perspective view of the device body viewed from below.
Figure 6:
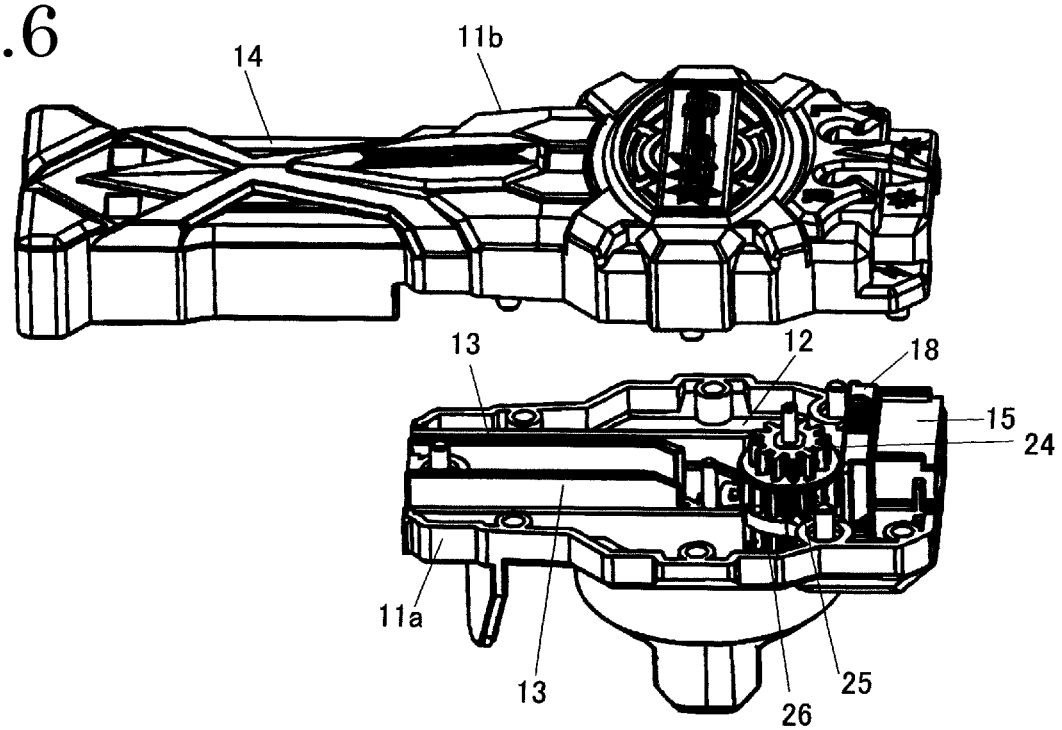
FIG. 6 is a perspective view showing the internal structure of the device body.

FIG. 4 is a perspective view of the device body 10, FIG. 5 is a perspective view of the device body 10 viewed from below, and FIG. 6 is a perspective view showing the internal structure of the device body 10. In the explanation of the device body 10, "front and rear," "left and right," and "up and down" mean the directions shown in FIG. 4.

The device body 10 includes a housing 11. The housing 11 is configured from a lower side housing 11*a* and an upper side housing 11*b*. The upper side housing 11*b* has front and rear direction dimensions greater than those of the lower side housing 11*a*.

The front half of the lower housing 11*a* and the upper housing 11*b* are joined to each other by a screw (not illustrated). A portion of a mechanical parts housing part 12 and a belt passage 13 are formed in a space sandwiched by the lower housing 11*a* and the upper housing 11*b* front half. Also, the back half of the upper housing 11*b* that projects more to the rear than the lower housing 11*a* in a joined state constitutes a handle 14 that can be gripped with one hand, and a portion of the belt passage 13 is formed there.

On the front part of the housing 11, a belt insertion port 15 for insertion of the belt part 51 of the operating belt 50 is provided. Four rectangular (first, third, second, fourth) insertion holes 16L, 16R, 17L, 17R are formed distributed up and down and left and right in the belt insertion port 15. Of these, the insertion holes 16L, 16R are formed at the upper left and right of the belt insertion port 15, and the other insertion holes 17L, 17R are formed at the lower left and right of the belt insertion port 15. The distance between the insertion holes 16L, 16R corresponds to the diameter of a first input gear (rotor) 24 described later, and is set to be smaller than the distance between the insertion holes 17L, 17R corresponding to the diameter of a second input gear (rotot) 25. The belt part 51 of the operating belt 50 is selectively inserted in these insertion holes 16L, 16R, 17L, 17R.

Here, the upper insertion holes 16L, 16R are holes used to rotationally energize the top 70 at high speed, and the lower insertion holes 17L, 17R are holes used to rotationally energize the top 70 at low speed. Also, the left insertion holes 16L, 17L are holes for rotationally energizing the top 70 clockwise, and the right insertion holes 16R, 17R are holes for rotationally energizing the top 70 counterclockwise.

Figure 7:
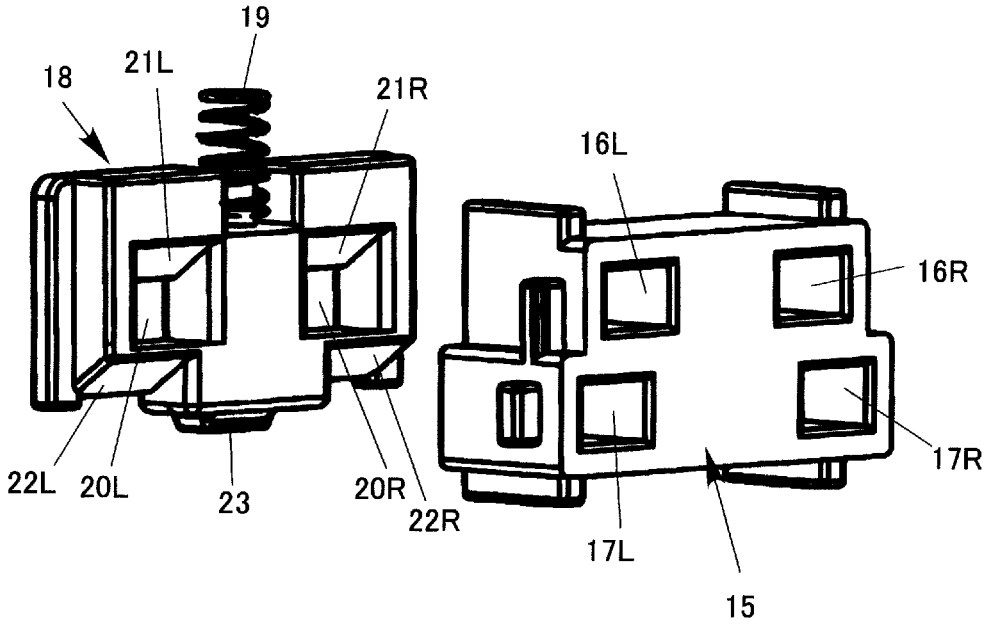
FIG. 7 is a perspective view showing a belt insertion port and a locking member.

FIG. 7 is a perspective view showing the belt insertion port 15 and a slide member 18.

As shown in FIG. 6, in the interior of the housing 11, the slide member (locking member) 18 is provided in contact with the back surface of the belt insertion port 15 with the ability to move up and down. This slide member 18 is urged downward by a coil spring 19 that is interposed between itself and the upper housing 11*b*. For convenience of explanation, in FIG. 7, the belt insertion port 15 and the slide member 18 are shown separated.

The slide member 18 constitutes a portion of the hold release mechanism and does the work of separating the rotationally energized top 70 from the device body 10, and in the state with the operating belt 50 pulled out from the device body 10, does the work of inhibiting rotation of the top holder 31.

In the slide member 18, two insertion through holes 20L, 20R corresponding to the upper insertion holes 16L, 16R are formed at left and right. The upper wall lower surface of each insertion through hole 20L, 20R are inclined surfaces 21L, 21R. The incline direction is the direction of the slide member 18 being lifted upward in resistance to the urging force of the coil spring 19 by sliding contact of the belt part 51 on the inclined surfaces 21L, 21R when the belt part 51 of the operating belt 50 is inserted from the upper insertion holes 16L, 16R.

On the other hand, at the lower side of the slide member 18 as well, inclined surfaces 22L, 22R are formed corresponding to the abovementioned insertion holes 17L, 17R. The incline direction is the direction of the slide member 18 being lifted up in resistance to the urging force of the coil spring 19 by sliding contact of the belt part 51 on the inclined surfaces 22L, 22R when the belt part 51 of the operating belt 50 is inserted from the lower insertion holes 17L, 17R.

Furthermore, on the lower side of the slide member 18, a locking unit 23 is formed projecting downward between the inclined surfaces 22L, 22R.

The technical significance of the vertical movement of the slide member 18 and the technical significance of the locking unit 23 are described later.

Figure 8:
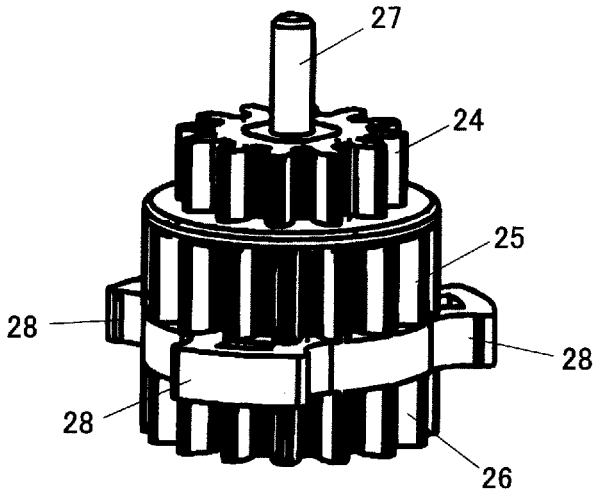
FIG. 8 is a perspective view of a first input gear, a second input gear, and a coupling gear.

FIG. 8 is a perspective view of the first input gear 24, the second input gear 25, and a coupling gear 26.

In the interior of the housing 11, at the rear (back) of the slide member 18, the first input gear 24, the second input gear 25, and the coupling gear 26 are provided in this order from top to bottom. The first input gear 24, the second input gear 25, and the coupling gear 26 are provided on a shaft (first shaft) 27 extending in the vertical direction, and are configured to rotate integrally. The coupling gear 26 in this case constitutes a coupling rotor that couples the first input gear 24, the second input gear 25, and the top holder 31 described later.

Here, the diameter of the first input gear 24 is smaller than that of the second input gear 25, and the number of teeth is fewer by that amount. Teeth 51*b* of the belt part 51 of the operating belt 50 inserted from the upper insertion holes 16L, 16R mesh with the first input gear 24. Meanwhile, teeth 51*b* of the belt part 51 of the operating belt 50 inserted from the lower insertion holes 17L, 17R mesh with the second input gear 25. When inserting the operating belt 50 from insertion holes 16L, 17L, and when inserting the operating belt 50 from insertion holes 16R, 17R, it is necessary to change the direction of the operating belt 50.

Figure 9:
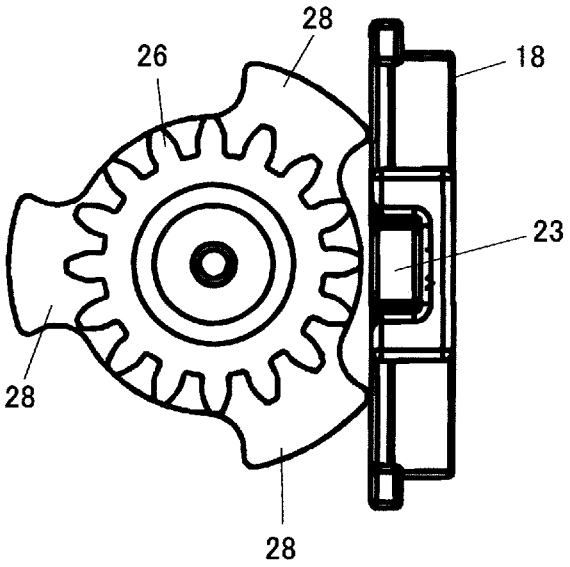
FIG. 9 is a bottom view of the locking member and the coupling gear.

FIG. 9 is a bottom view of the slide member 18 and the coupling gear 26.

Though not specifically limited, the second input gear 25 and the coupling gear 26 are configured integrally sandwiching a locked piece 28 with the same diameter and the same number of teeth. There are three locked pieces 28 provided at equal intervals in the circumferential direction to overhang from the outer periphery of the second input gear 22 and the coupling gear 26. The locked pieces 28 constitute the hold release mechanism together with the slide member 18.

The gap between adjacent locked pieces 28, 28 is larger than the locking unit 23 of the slide member 18. Then, the locking unit 23 of the slide member 18 is configured to be able to enter between adjacent locked pieces 28, 28 from above by the urging force of the coil spring 19. When the slide member 18 drops and the locking unit 23 enters between adjacent locked pieces 28, 28, rotation of the first input gear 24, the second input gear 25, and the coupling gear 26 is stopped by the locking unit 23. That is, when the operating belt 50 is pulled out from the device body 10, rotation of the top holder 31 is stopped. As a result, it is possible to separate the rotationally energized top 70 from the top holder 31. Meanwhile, in a state with the slide member 18 raised, rotation of the first input gear 24, the second input gear 25, and the coupling gear 26 is allowed. That is, the top holder 31 is rotated until the operating belt 50 is pulled out from the device body 10. As a result, it is possible to rotationally energize the top 70.

Figure 10:
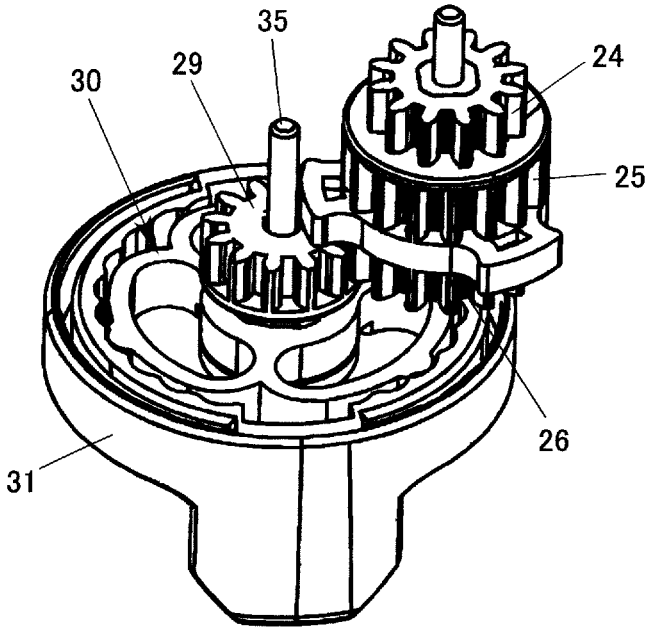
FIG. 10 is a perspective view showing a power transmission mechanism from the first input gear and the second input gear to a top holder.
Figure 11:
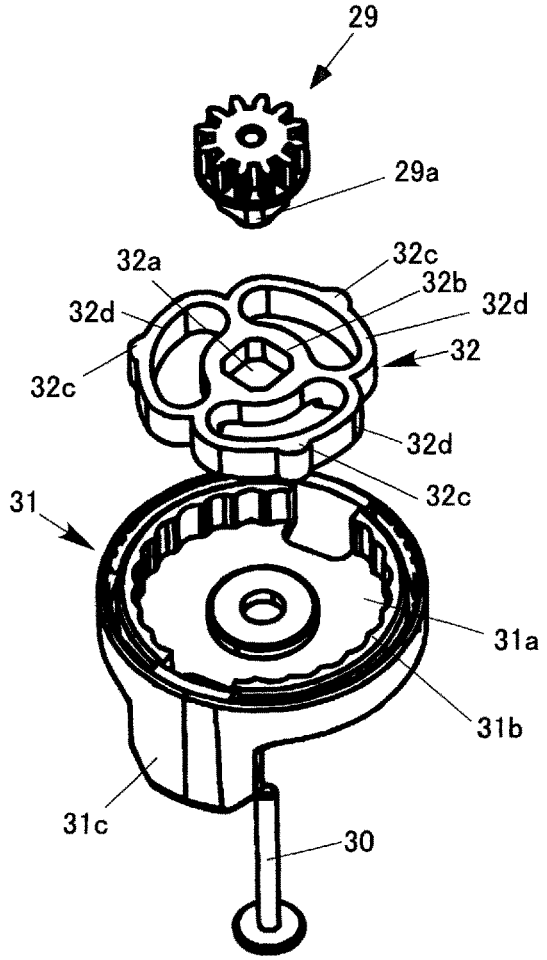
FIG. 11 is an exploded perspective view of the output gear, a clutch, and the top holder.

FIG. 10 is a perspective view showing the power transmission mechanism of from the first input gear 24 and the second input gear 25 to the top holder 31, and FIG. 11 is an exploded perspective view of a coupling gear 29, a clutch 30, and the top holder 31. The coupling gear 29 and the clutch 30 in this case constitute the coupling rotor that couples the first input gear 24, the second input gear 25 with the top holder 31 described later.

In the interior of the housing 11, the coupling gear 29 that meshes with the coupling gear 26 is provided to the rear (back) of the first input gear 24, the second input gear 25, and the coupling gear 26. The coupling gear 29 is attached to a shaft 35. This coupling gear 29 is coupled with the top holder 31 with a meshing clutch 30 interposed.

Specifically, a shaft part 29*a* having undergone double D cutting in the central part is provided on the bottom surface of the coupling gear 29. This shaft part 29*a* is coupled to one rotation element 32 constituting the meshing clutch 30. The rotation element 32 includes a core body 32*b* in which is formed a fitting hole 32*a* in which the shaft part 29*a* fits, and a band-shaped elastic locking unit 32*d* that swells radially outward of the core body 32*b* and has a projection 32*c* at the outside of the center part. There are three of these elastic locking units 32*d* formed at equal intervals in the circumferential direction. Meanwhile, a circular recess 31*a* in which the rotation element 32 sits is formed in the top holder 31. A large number of meshing teeth 31*b* are formed in the circumferential direction on the projection 32*c* on the peripheral wall of the circular recess 31*a*. The peripheral wall of the circular recess 31*a* on which the teeth 31*b* are formed constitutes the other rotation element. Then, the rotational force of the coupling gear 29 is transmitted to the top holder 31 by meshing of the projections 32*c* and the teeth 31*b*, and when an excess load acts on the top holder 31, meshing of the projections 32*c* and the teeth 31*b* is released.

As shown in FIG. 5, two insertion pieces 31*c*, 31*c* are attached to the opposing parts sandwiching the shaft 35 on the top holder 31. The two insertion pieces 31*c*, 31*c* are inserted in a corresponding arc-shaped groove 73 provided on the top surface of the trunk part 72 of the top 70 when mounting the top 70. Then, when the two insertion pieces 31*c*, 31*c* are inserted in the corresponding arc-shaped groove 73, the center line of the top and the center line of the shaft 35 match. The locking projection 31*d* is formed on the inside of each insertion piece 31*c*. Then, each insertion piece 31*c* is inserted in the arc-shaped groove 73 of the top 70, and by relatively rotating the top 70 in the direction opposite to the rotationally energized direction of the top 70 with respect to the top holder 31, the locking projection 31*d* gets under the edge wall of the narrow-width part 73*a* of the arc-shaped groove 73 and engages. As a result, the top 70 is held by the top holder 31.

Next, a usage example of this top launching device 100 is explained.

The top 70 is mounted on the device body 10, and the belt part 51 of the operating belt 50 is inserted in one of the insertion holes 16L, 16R, 17L, 17R.

In this case, if the top 70 is a top for counterclockwise rotation, the belt part 51 is inserted in one of the insertion holes 16R, 17R so that the teeth 51*b* are positioned at the left of the belt part 51, and on the other hand, if the top 70 is a top for clockwise rotation, the belt part 51 is inserted into one of the insertion holes 16L, 17L so that the teeth 51*b* are positioned at the right of the belt part 51. Whether inserted in one of the insertion holes 16R, 17R or inserted in one of the insertion holes 16L, 17L is determined by whether one wishes to rotate the top 70 at high speed or rotate at low speed.

Then, when the belt part 51 of the operating belt 50 is inserted into one of the insertion holes 16L, 16R, 17L, 17R, the slide member 18 is lifted up in resistance to the urging force of the coil spring 19, and the first input gear 24 and the second input gear 25 are in a rotatable state.

In this state, the top 70 is faced down, and the operating belt 50 is vigorously pulled out from the device body 10. As a result, the top 70 is rotationally energized in the desired direction, and when the operating belt 50 is separated from the device body 10, the slide member 18 drops by the energizing force of the coil spring 19, and according to the rotation of the top holder 31, the locking unit 23 enters between adjacent locked pieces 28, 28. As a result, the rotation of the top holder 31 is stopped while the top 70 is rotated by inertial force, so the locking projection 31*d* sticks out from below the edge wall of the narrow-width part 73*a* of the arc-shaped groove 73, and the top 70 is launched from the device body 10.

Second Embodiment

Figure 12:
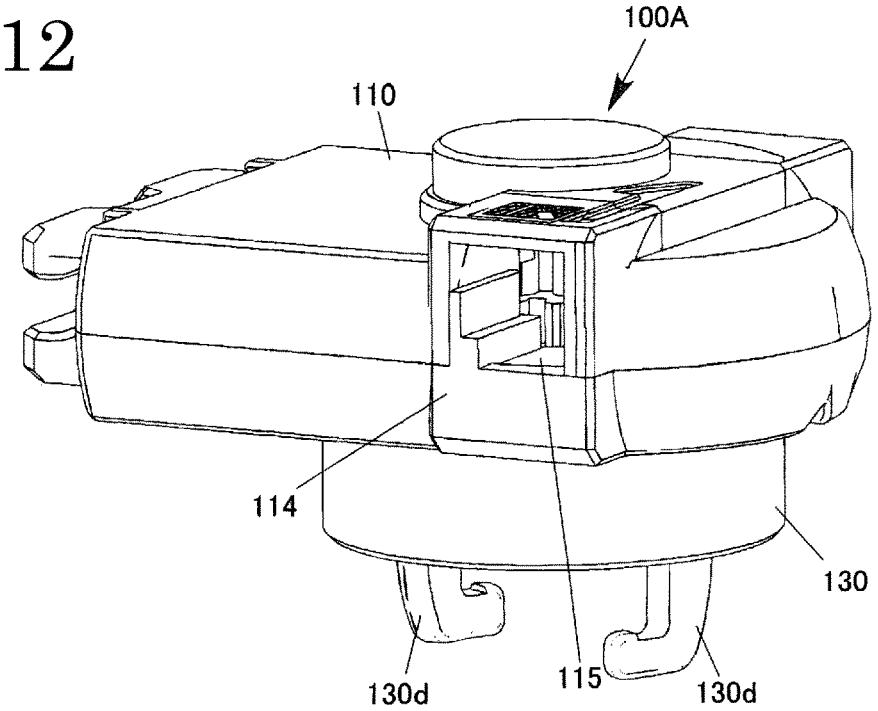
FIG. 12 is a perspective view of the device body of the top launching device of a second embodiment.
Figure 13:
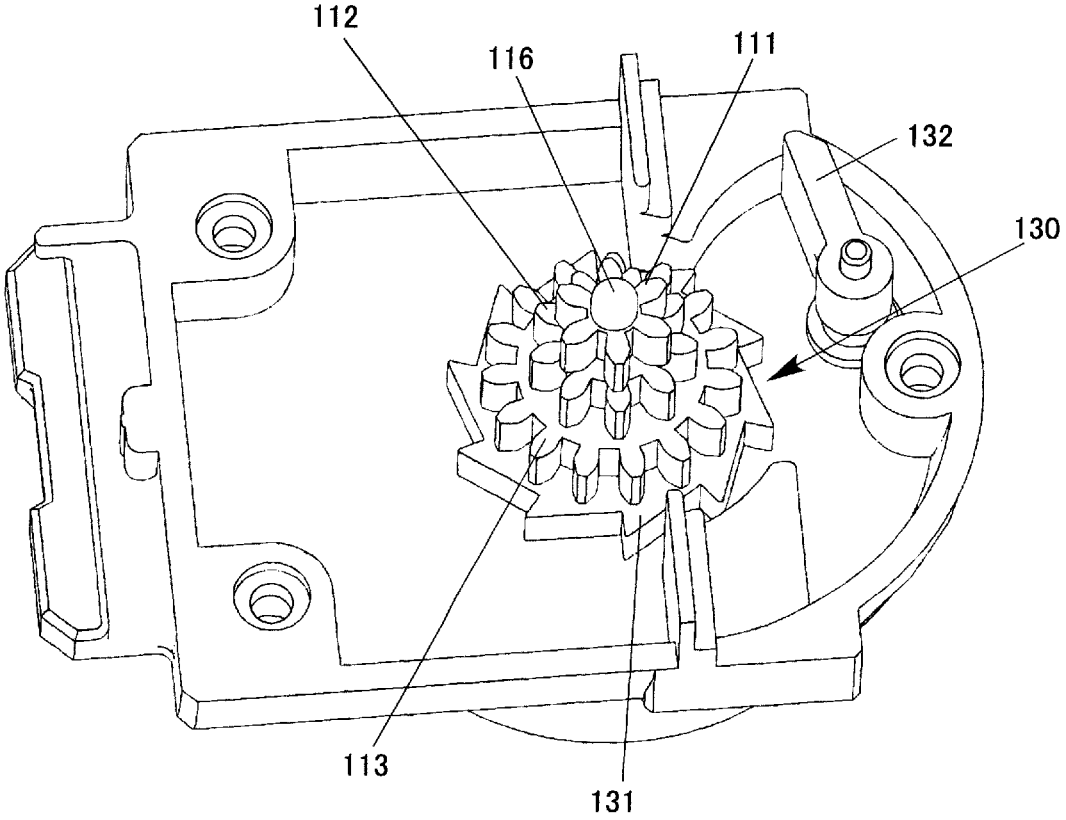
FIG. 13 is a perspective view of the internal structure of the device body.

FIG. 12 is a perspective view of a device body 110 of a top launching device 100A according to a second embodiment, and FIG. 13 is a perspective view of the internal structure of the device body 110.

The first point of difference between the top launching device 100A of the second embodiment and the top launching device 100 of the first embodiment is that a first input gear 111, a second input gear 112, and a third input gear 113 are provided in the device body 110, there are operating belts 150, 151, 152, and belt parts 150*b*, 151*b*, 152*b* of the operating belts 150, 151, 152 can be selectively inserted in an insertion hole 115 of one belt insertion port 114 of the device body 110.

The first input gear 111, the second input gear 112, and the third input gear 113 are attached to one shaft (first shaft) 116, and the diameter and number of teeth become greater in this order from top to bottom. That is, the first input gear 111, the second input gear 112, and the third input gear 113 have mutually different rotation gear ratios. The operating belts 150, 151, 152 correspond to the first input gear 111, the second input gear 112, and the third input gear 113.

Figure 14:
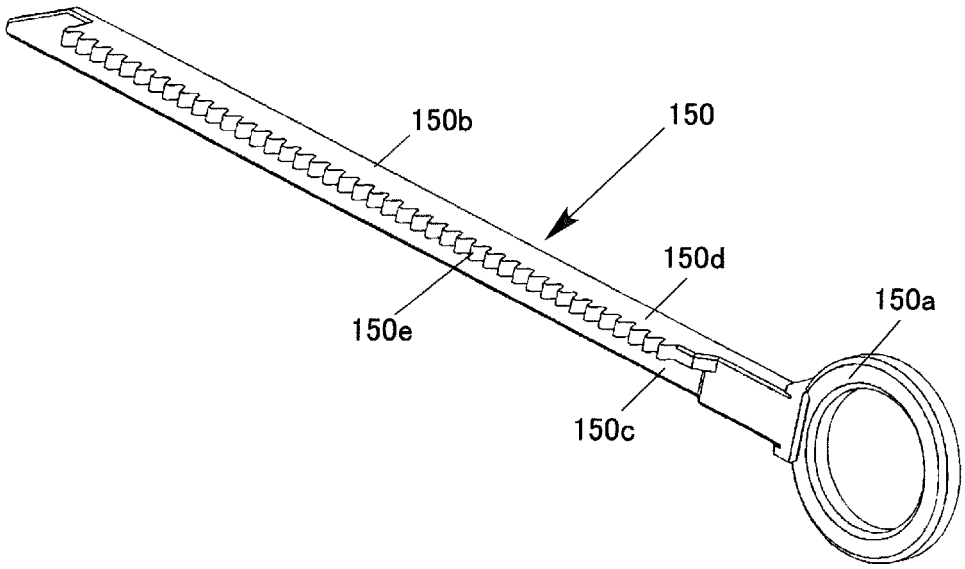
FIG. 14 is a perspective view of the operating belt that meshes with the first input gear.
Figure 15:
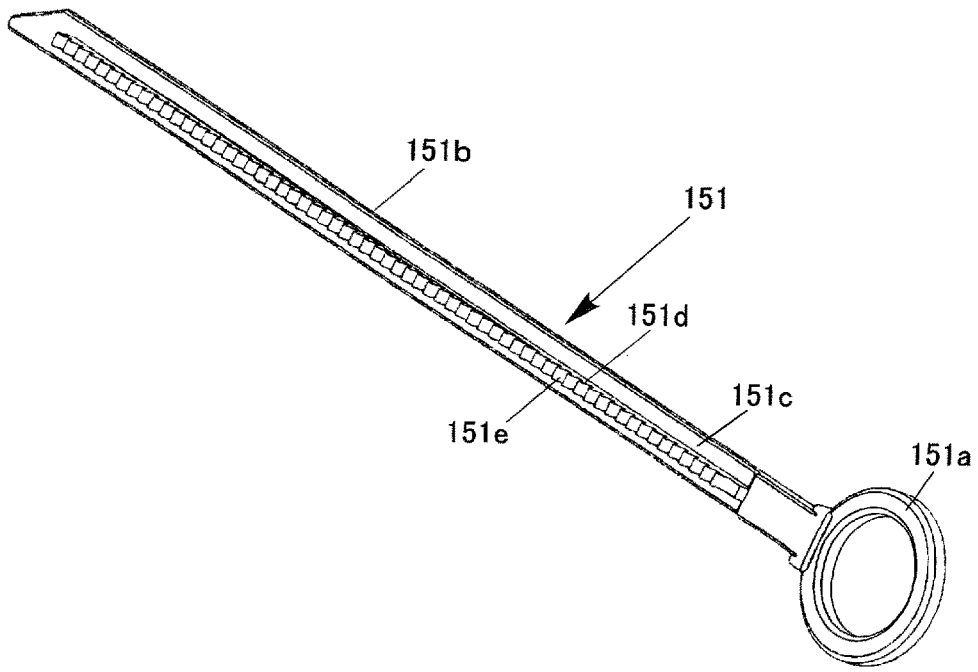
FIG. 15 is a perspective view of the operating belt that meshes with the second input gear.
Figure 16:
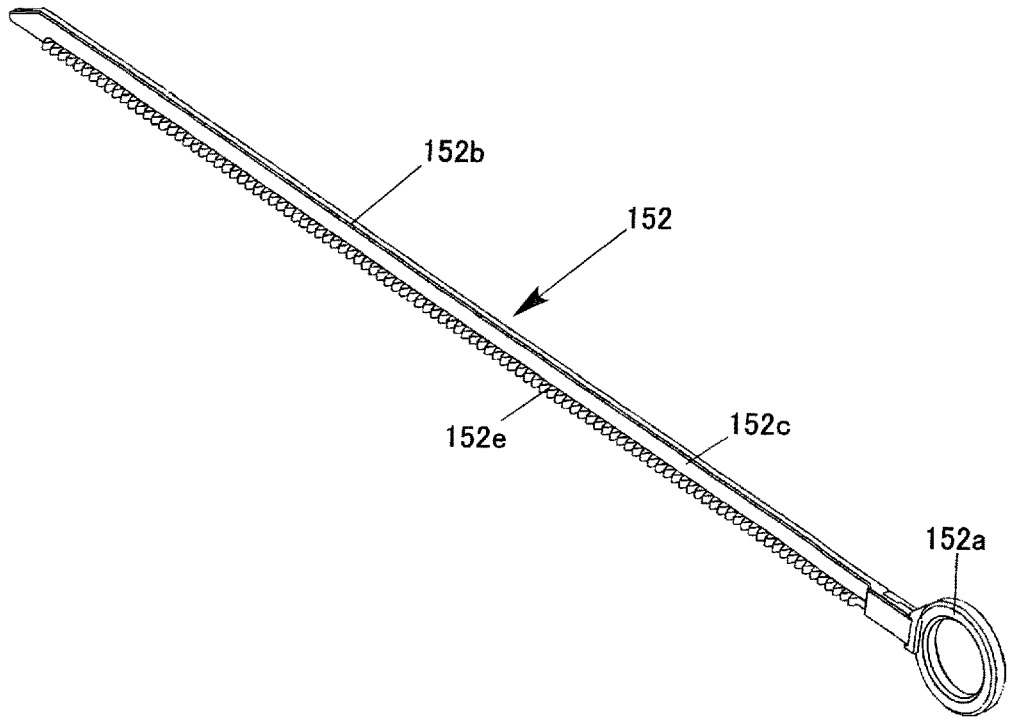
FIG. 16 is a perspective view of the operating belt that meshes with a third input gear.

FIG. 14 is a perspective view of the operating belt 150 that meshes with the first input gear 111, FIG. 15 is a perspective view of the operating belt 151 that meshes with the second input gear 112, and FIG. 16 is a perspective view of the operating belt 152 that meshes with the third input gear 13.

The operating belt 150 is a belt that meshes with the first input gear 111 to rotate the top 70 at high speed, the operating belt 151 is a belt that meshes with the second input gear 112 to rotate the top 70 at medium speed, and the operating belt 152 is a belt that meshes with the third input gear 113 to rotate the top 70 at low speed. Ring-shaped finger hooking parts 150*a*, 151*a*, 152*a* are provided on the operating belts 150, 151, 152.

Here, in the operating belts 150, 151, 152, the belt parts 150*b*, 151*b*, 152*b* have mutually different shapes.

The belt part 150*b* of the operating belt 150 has a reverse L shape for the cross section orthogonal to the longitudinal direction. In specific terms, the belt part 150*b* is constituted from a standing part 150*c* in which the right surface abuts the right wall of the insertion hole 115, and an overhang part 150*d* that overhangs leftward from the top end part of the standing part 150*c* and the top surface abuts the top wall of the insertion hole 115, and teeth 150*e* are formed on the free end surface of the overhang part 150*d*. The teeth 150*e* are meshed with the first input gear 111.

Also, a belt part 151*b* of the operating belt 151 is constituted from a standing part 151*c* in which the right surface abuts the right wall of the insertion hole 115, and an overhang part 151*d* that overhangs leftward from the center part in the vertical direction of the standing part 151*c*, and teeth 151*e* are formed on the free end surface of the overhang part 151*d*. The teeth 151*e* mesh with the second input gear 112.

Also, a belt part 152*b* of the operating belt 152 has a standing part 152*c* in which the right surface abuts the right wall of the insertion hole 115, and teeth 152*e* are formed on the bottom end part of the left surface of the standing part 152*c*. The teeth 152*e* mesh with the third input gear 113.

Also, the second point of difference between the top launching device 100A of the second embodiment from the top launching device 100 of the first embodiment is that the hold release mechanism 130 is constituted by a ratchet wheel 131 in which the periphery is in sawtooth form, a claw 132, and a spring (not illustrated) that urges the claw 132 in the direction that engages with the ratchet wheel 131.

According to this hold release mechanism 130, the claw 132 meshes with the gear 131 by the urging force of the spring (not illustrated). Then, when one of the operating belts 150, 151, 152 is inserted from the insertion hole 115 of the belt insertion port 114 of the device body 110, with pressing by the belt part 150*b*, 151*b*, 151*c*, the claw 132 is separated from the gear 131. Also, when the operating belts 150, 151, 152 are pulled out from the device body 110, they are meshed with the gear 131 by the urging force of the spring (not illustrated), and rotation of the first input gear 111, the second input gear 112, and the third input gear 113 is stopped.

Also, the third point of difference of the top launching device 100A of the second embodiment from the top launching device 100 of the first embodiment is that the center line of a shaft 116 of the first input gear 111, the second input gear 112, and the third input gear 113 match the center line of the shaft (not illustrated) of the top holder 130. Specifically, with the top launching device 100A of the second embodiment, gears correlating to the coupling gear 26 and the coupling gear 29 of the top launching device 100 of the first embodiment are not provided. Meanwhile, though not illustrated, with the top launching device 100A of the second embodiment, the first input gear 111, the second input gear 112, and the third input gear 113 are coupled with the top holder 130 by the same type of clutch as the clutch 30 of the top launching device 100 of the first embodiment.

Also, a fourth point of difference of the top launching device 100A of the second embodiment from the top launching device 100 of the first embodiment is that it is possible for the top holder 130 to mount only the top 70 for turning clockwise. Specifically, a hook 130*d* is formed on each of two insertion pieces 130*c*, 130*c* of the top holder 130, and after insertion of each insertion piece 130*c* in the arc-shaped groove 73 of the top 70, by doing relative rotation of the top 70 counterclockwise with respect to the top holder 130, the hook 130*d* gets under the end edge of the arc-shaped groove 73, holding the top 70 in the top holder 130.

A handle (not illustrated) is detachable with the device body 110 of the top launching device 100A of the second embodiment.

Third Embodiment

Figure 17:
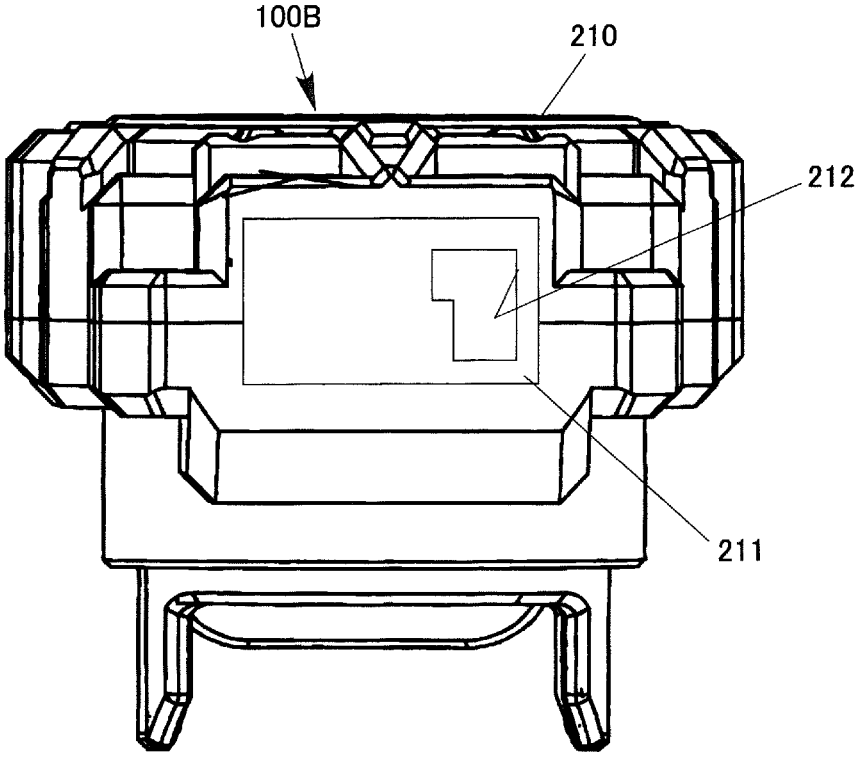
FIG. 17 is a front view of the device body of the top launching device according to a third embodiment.
Figure 18:
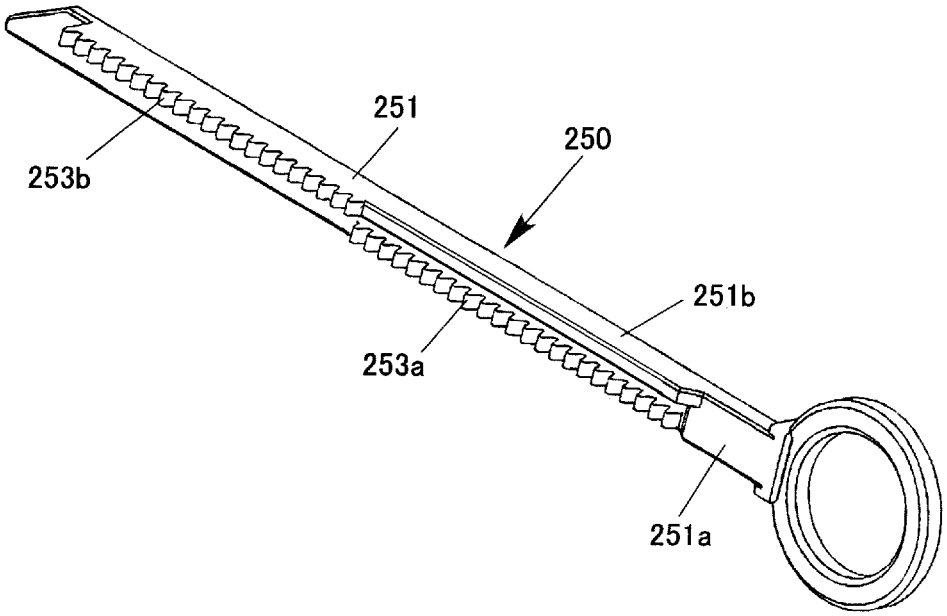
FIG. 18 is a perspective view of the operating belt that meshes with the first input gear and the second input gear.

FIG. 17 is a front view of a device body 210 of a top launching device 100B according to a third embodiment, and FIG. 18 is a perspective view of an operating belt 250 that meshes with the first input gear 24 and the second unput gear 25. The first input gear 24 and the second input gear 25 are the same as those of the top launching device 100 of the first embodiment so the same code numbers are used, and illustrations are omitted.

A first difference of the top launching device 100B of the third embodiment from the top launching device 100 of the first embodiment is that there is one insertion hole 212 of a belt insertion port 211 provided in the device body 210, and a second is that on a belt part 251 of one operating belt 250, teeth 253*a*, 253*b* that mesh selectively with the first input gear 24 and the second input gear 25 when the operating belt 250 is pulled out are formed at different locations in the longitudinal direction.

The belt part 251 of the operating belt 250 has a cross section that is a reverse L shape orthogonal to the longitudinal direction. In specific terms, the belt part 251 is constituted from a standing part 251 in which the right surface abuts the right wall of the insertion hole 212, and an overhang part 251*b* that overhangs leftward from the top end part of the standing part 251*a*, and on the left surface of the standing part 251*a* and the overhang part 251*b*, teeth 253*a*, 253*b* are formed at different locations in the longitudinal direction. In specific terms, teeth 253*a* that mesh with the second input gear 25 are formed on the base end side half of the belt part 251 of the left surface of the standing part 251*a*, and teeth 253*a* that mesh with the first input gear 24 are formed on the tip end side half of the overhang part 251*b*.

According to this top launching device 100B, in accordance with pulling out of the operating belt 250, first, by meshing with the teeth 253*a* of the belt part 251, the second input gear 25 is rotated, and after that, by meshing with the teeth 253*b* of the belt part 251, the first input gear 24 is rotated. As a result, it is possible to rotate the top 70 at a high speed with relatively small force.

Specifically, when the operating belt 250 is pulled out at the same speed, the case of moving the second input gear 25 having a larger diameter and number of teeth has a lower rotation speed of the top 70 compared to a case of moving the first input gear 24 with a smaller diameter and number of teeth, but it is accomplished with a smaller pulling force. In light of that, by moving the second input gear 25 first with smaller pulling force and giving a running start to the first input gear 24 that rotates integrally with the second input gear 25, the gear that inputs rotational force is switched to the first input gear 24. By doing this, the first input gear 24 is given a running start, and it is possible to rotate the first input gear 24 with a relatively small force, and also possible to rotate the top 70 at high speed.

Variation Example

In the embodiments noted above, the top 70 was held by the output rotor by doing relative rotation of the top 70 in one direction with respect to the output rotor, and by stopping the output rotor, by doing relative rotation of the top 70 in the other direction with respect to the output rotor, holding of the top 70 by the output rotor was released, but the hold release mechanism is not limited to this.

For example, it is also possible to use a claw that grips the outer periphery of the top 70, and to release holding of the top 70 by the output rotor by holding the top 70 and operating the claw using a button operation, or to hold the top 70 by fitting in the output rotor, and to release holding of the top 70 by the output rotor by pushing out the top 70 using a button operation.

Also, in the embodiments noted above, the input rotor was an input gear, but it is also possible to have rotational force inputted by friction with the operating belt as an input roller.

In the embodiments above, various structures were presented, but it goes without saying that it is possible to use various combinations of these structures in a scope that is not inconsistent.

Effect of the Invention

According to the present invention, a plurality of individual input rotors having mutually different gear ratios are provided in a device body, an operating belt is selectively engaged with one of the plurality of individual input rotors, and by pulling out the operating belt from the device body, it is possible to easily change the rotation speed of the top being launched.

What is claimed is:

1. A top launching device for launching a top, comprising:

a device body including first and second input rotors to rotate by rotational force, an output rotor configured to hold the top in a state with a central axis of the output rotor aligned with a central axis of the top and configured to rotate and impart the rotational force to the top, and a coupling rotor configured to transmit the rotational force from the first and second input rotors to the output rotor;

an operating belt configured to be inserted in the device body, and to be engaged with either the first or the second input rotor when the operating belt is in the device body, the first and the second input rotors configured to rotate by a user pulling the operating belt from the device body, the output rotor configured to rotate the top, impart the rotational force to the top, and release the top, the first input rotor having a first gear ratio, the second input rotor having a second gear ratio being different from the first gear ratio, the operating belt configured to be selectively engaged with one of the first and second input rotors.

2. The top launching device according to claim 1, wherein the first and second input rotors are input gears.

3. The top launching device according to claim 2, wherein the first and second input rotors are attached to a first shaft, the first input rotor has a first diameter and includes a first number of teeth, the second input rotor has a second diameter and includes a second number of teeth, the first diameter is different from the second diameter, and the first number is different from the second number.

4. The top launching device according to claim 3, wherein the first shaft extends in a vertical direction, and the second diameter is larger than the first diameter, and the second input rotor is configured lower than the first input rotor in the vertical direction.

5. The top launching device according to claim 3, wherein the device body includes a belt insertion port, the belt insertion port includes a first insertion hole for the operating belt to be inserted in order to be engaged with the first input rotor for rotating the first input rotor in a first direction, and the belt insertion port includes a second insertion hole for the operating belt to be inserted in order to be engaged with the second input rotor for rotating the first input rotor in the first direction.

6. The top launching device according to claim 5, wherein the belt insertion port includes a third insertion hole for the operating belt to be inserted in order to be engaged with the first input rotor for rotating the first input rotor in a second direction opposite to the first direction, and the belt insertion port includes a fourth insertion hole for the operating belt to be inserted in order to be engaged with the second input rotor for rotating the second input rotor in the second direction.

7. The top launching device according to claim 5, further comprising a hold release mechanism configured to release the top by stopping rotation of the output rotor when the output rotor holds the top, wherein the hold release mechanism includes a locked part configured on a rotor, which is engaged with the output rotor, to rotate integrally with the rotor, a locking member configured to move between first and second positions, and a urging member configured to urge the locking member toward the first position, the operating belt is configured to press the locking member toward the second position during insertion of the operating belt into the device body, the locking member configured to stop rotation of the locked part when at the first position, and the locking member configured to allow the rotation of the locked part when at the second position.

8. The top launching device according to claim 5, comprising a hold release mechanism configured to release the top by stopping rotation of the output rotor when the output rotor holds the top, wherein the hold release mechanism includes a locked part configured on a rotor, which is engaged with the output rotor, to rotate integrally with the rotor, a locking member configured adjacent to the insertion port to move between first and second positions, where the locking member is movable in an axial direction of the rotor and a urging member configured to urge the locking member toward the first position, the operating belt is configured to press the locking member toward the second position during insertion of the operating belt into the device body, the locking member configured to stop rotation of the locked part when at the first position, and the locking member configured to allow the rotation of the locked part when at the second position.

9. A top launching device for launching a top, comprising:

a device body including first and second input rotors to rotate by rotational force, an output rotor configured to hold the top in a state with a central axis of the output rotor aligned with a central axis of the top and configured to rotate and impart the rotational force to the top, and a coupling rotor configured to transmit the rotational force from the first and second input rotors to the output rotor;

a first operating belt configured to be inserted in the device body, and to be engaged with either the first or the second input rotor when the operating belt is in the device body; and a second operating belt configured to be inserted in the device body, and to be engaged with either the first or the second input rotor when the second operating belt is in the device body, the first and the second input rotors configured to rotate by a user pulling the first and second operating belts from the device body, the output rotor configured to rotate the top, impart the rotational force to the top, and release the top, the first input rotor having a first gear ratio, the second input rotor having a second gear ratio being different from the first gear ratio, the first or the second operating belt selectively employed to be selectively engaged with one of the first and second input rotors.

10. A top launching device for launching a top, comprising:

a device body including first and second input rotors to rotate by rotational force, an output rotor configured to hold the top in a state with a central axis of the output rotor aligned with a central axis of the top and configured to rotate and impart the rotational force to the top, and a coupling rotor configured to transmit the rotational force from first and second the input rotors to the output rotor;

an operating belt configured to be inserted in the device body, and to be engaged with either the first or the second input rotor when the operating belt is in the device body, the first and the second input rotors configured to rotate by a user pulling the operating belt from the device body, the output rotor configured to rotate the top, impart the rotational force to the top, and release the top, the first input rotor having a first gear ratio, the second input rotor having a second gear ratio being different from the first gear ratio, the operating belt configured to be selectively engaged with one of the first and second input rotors, the first and second input rotors being input gears, the first and second input rotors being attached to a first shaft, the first input rotor having a first diameter and including a first number of teeth, the second input rotor having a second diameter and including a second number of teeth, the first diameter being different from the second diameter, the first number being different from the second number, the first shaft extending in a vertical direction, the second diameter being larger than the first diameter, the second input rotor being configured lower than the first input rotor in the vertical direction, the device body including a belt insertion port, the belt insertion port including a first insertion hole for the operating belt to be inserted in order to be engaged with the first input rotor for rotating the first input rotor in a first direction, the belt insertion port including a second insertion hole for the operating belt to be inserted in order to be engaged with the second input rotor for rotating the first input rotor in the first direction, the belt insertion port including a third insertion hole for the operating belt to be inserted in order to be engaged with the first input rotor for rotating the first input rotor in a second direction opposite to the first direction, the belt insertion port including a fourth insertion hole for the operating belt to be inserted in order to be engaged with the second input rotor for rotating the second input rotor in the second direction.

* * * * *